United States Patent [19]

Bourdeau

[11] 4,415,511

[45] Nov. 15, 1983

[54] ROTARY ATOMIZING PROCESS

[75] Inventor: Romeo G. Bourdeau, Tequesta, Fla.

[73] Assignee: United Technologies Corporation, Hartford, Conn.

[21] Appl. No.: 453,190

[22] Filed: Dec. 27, 1982

[51] Int. Cl.[3] ..... B01J 2/02

[52] U.S. Cl. ..... 264/8

[58] Field of Search ..... 264/8

[56] References Cited

U.S. PATENT DOCUMENTS

| | | | |
|---|---|---|---|
| 2,699,576 | 1/1955 | Colbry et al. | 264/8 |
| 3,721,511 | 3/1973 | Schlienger | 264/8 |
| 4,069,045 | 1/1978 | Lundgren | 264/8 |
| 4,140,462 | 2/1979 | Thompson | 264/8 |
| 4,178,335 | 12/1979 | Metcalfe et al. | 264/8 |
| 4,207,040 | 6/1980 | Metcalfe et al. | 264/8 |
| 4,310,292 | 1/1982 | Carlson et al. | 425/8 |

FOREIGN PATENT DOCUMENTS 754180 8/1956 United Kingdom .

*Primary Examiner*—James R. Hall

*Attorney, Agent, or Firm*—Stephen E. Revis

[57] ABSTRACT

In the process of forming metal powders by rotary atomization, the atomizer disk is first coated with a stable compound of the molten metal to be poured or, if the metal to be poured is an alloy, the disk is coated with a compound of the base metal of the alloy. The coating compound is selected on the basis of its melting point and that it can coexist with the molten metal to be poured, at the pour temperature, as indicated by phase diagrams of the materials involved. The molten metal is poured onto the coated, spinning disk, couples with the coating, and forms a stable skull of itself over the coating. Fine droplets of molten metal are thereafter flung from the disk, cooled and collected.

16 Claims, No Drawings

ROTARY ATOMIZING PROCESS

DESCRIPTION

CROSS REFERENCE TO RELATED PATENT APPLICATIONS

This application is of related subject matter to commonly owned U.S. Patent Application Ser. No. 453,197, filed 12-27-82 herewith titled "Modified RSR Rotary Atomizer" by Robert J. Patterson, II.

TECHNICAL FIELD

This invention relates to atomizing molten metals.

BACKGROUND ART

It is well known in the art to form metal powders and metal splats by pouring molten metal onto the top surface of a spinning disk which flings molten metal droplets outwardly into a quenching chamber and/or against a splat plate. The body of the atomizer disk is typically made from a high strength metal which can withstand the centrifugal loads at the high rotational speeds and temperatures to which it will be subjected. The bodies of atomizer disks are typically made from a high thermal conductivity metal, such as copper or a copper alloy which is water cooled to resist melting and/or erosion. Unfortunately, this results in an excessive amount of heat being removed from the metal being poured onto the disk, necessitating the use of large amounts of superheat (i.e., high molten metal pour temperatures) which can cause difficulties including possible melting at the center of the atomizer disk. It was also early on recognized that metals most suitable for forming the structural portion of the atomizer disk sometimes reacted with the molten metal being poured, thereby contaminating the metal powder being manufactured. The above problems intensify when atomizing metals which become highly reactive at high pour temperatures, or when the metal being atomized is an alloy having a large solidification range which requires even higher molten metal pour temperatures than would be required for atomizing the individual elements of the alloy.

One early solution to this problem involved lining the top surface of the metal atomizer disk with a refractory material, as shown in U.S. Pat. No. 2,439,772 to J. T. Gow. The refractory material, in addition to providing thermal protection for the underlying metal of the disk, was also felt to be inert or nonreactive to most molten metals. Even today the state-of-the-art of high speed rotary atomization for making powdered metal involves pouring the molten metal onto a ceramic layer which has been bonded to the surface of a metal atomizer disk, as is shown in U.S. Pat. Nos. 4,178,335 to R. A. Metcalfe and R. G. Bourdeau and 4,310,292 to R. L. Carlson and W. H. Schaefer, both owned by the assignee of the present application.

As discussed in hereinabove referred to U.S. Pat. No. 4,178,335, it is desirable, if not required, to form a solidified, stable "skull" on the ceramic surface of the atomizer disk of the metal being poured to get proper atomization. In the case of alloys having a large solidification zone, it is difficult and often not possible to obtain coupling between the ceramic disk surface and the molten alloy. In U.S. Pat. No. 2,699,576, to Colbry et al, magnesium is to be atomized on a steel disk (not ceramic coated). To achieve coupling Colbry et al adds zinc and zirconium to the magnesium.

Aluminum alloys and some other alloys having high concentrations of transition and other elements (i.e., Fe, Ni, Mo, Cr, Ti, Zr, and Hf) have very high melting temperatures and become very reactive toward many materials, including ceramics; and they also may possess a very large solidification range, in some cases over 500° F., which prevents the formation of a skull or solidified layer on the surface of the atomizer. A number of other alloys, including off eutectic alloys of iron, copper, nickel and cobalt, belong to a class which also has a large solidification range and are therefore difficult to atomize properly. Other alloys, including the reactive metals chromium, titanium, zirconium, and magnesium, are a problem because of their high reactivity with materials, and especially if they are alloyed with elements which increase their melting points and increase their solidification range.

From the foregoing it becomes apparent that ceramic coated atomizer disks of the prior art have some shortcomings which have not been resolved.

The following additional U.S. patents are representative of the state-of-the-art in the field of rotary atomization: Nos. 4,069,045; 3,721,511; 4,140,462; 4,207,040; and Brit. Pat. No. 754,180.

DISCLOSURE OF INVENTION

One object of the present invention is an improved process for forming metal powders by atomization.

A further object of the present invention is an improved process for forming metal powders from highly reactive metals.

Yet another object of the present invention is an improved process for forming powders of metals having wide liquidus/solidus temperature zones.

Accordingly, in the process of producing metal powder by pouring liquid metal onto the surface of a spinning disk wherein the metal is poured at a temperature considerably higher than its solidus temperature, the steps of (1) coating the disk with a stable compound of either the metal to be poured or, if the metal to be poured is an alloy, with a stabl compound of the base metal of said alloy, wherein the compound is one selected on the basis that it can coexist with said metal to be poured at the pour temperature of the metal to be poured, as indicated by phase diagrams of the materials involved, and the compound has a melting point significantly higher than the temperature at which the metal is to be poured, (2) pouring the liquid metal onto the coated spinning disk wherein coupling of the liquid with the compound occurs and a stable skull of the metal being poured is formed over the coating, (3) cooling the liquid droplets flung off the disk to solidify them, and (4) collecting the solidified metal or metal alloy.

The process of the present invention is intended for use in the atomization of (1) highly reactive metals (As used in the specification and in the claims the word "metal" means unalloyed metal as well as metal alloys, unless otherwise indicated.), and (2) those metals which have a large liquidus/solidus zone requiring pour temperatures at least 400° F. and often 700° F. or more above the solidus temperature of the material to be atomized. Prior art ceramic disk surfaces cannot always handle such materials due to erosion of the ceramic (as a result of reactions with the elements of the ceramic); and, in the case of metals having a wide solidification range, coupling between the ceramic and molten metal is prevented and a stable solidified skull does not form, preventing proper atomization.

With the process of the present invention the disk is coated with a compound which (1) is stable under process operating conditions, (2) has a melting point above the pour temperature of the material to be atomized, and (3) couples with the liquid metal being poured such that a solidified, stable skull of the metal being atomized can form on the surface of the compound. Coupling is assured, in the case where the metal being atomized has a high solidification range, by selecting the compound such that one of its elements (herein sometimes referred to as the primary element) is also the major element of the metal being atomized. The other element or elements (herein sometimes referred to as the secondary elements) of the compound are preferably selected to have low solubility in the major element of the material being atomized. However, while low solubility is preferred (to increase the likelihood that the coating will remain intact) this may not be required in all systems. The basic criterion is that the major element of the metal being atomized can coexist in molten form with the compound at the metal pour temperature, as indicated by phase diagrams of the materials involved. It is believed that even though, at the pour temperature, the secondary element of the coating compound is known to be soluble in the major element of the metal being poured, dissolving to a significant extent is unlikely to occur if, at the pour temperature, the binary phase diagram of the secondary and major elements shows that the compound of the two elements (i.e., the coating compound) can coexist with the major element of the metal being atomized.

In the cases where the metal to be atomized has a narrow solidification range but is highly reactive at pour temperatures, coupling and skull formation is not normally a problem. Rather, as in the preceding case, the liquid metal being atomized must be able to coexist with the coating compound at metal pour temperatures, as indicated by binary phase diagrams of the elements involved.

As is well known in the art, it is preferred, in order to protect the underlying metal body of the atomizer disk from melting, that there be a layer of low thermal conductivity ceramic under the coating compound. In other words, it is preferred that the disk have an insulating layer of ceramic over its metal body, and that the compound coating be formed on or applied over the ceramic layer.

The foregoing and other objects, features and advantages of the present invention will become more apparent in the light of the following detailed description of preferred embodiments thereof.

BEST MODE FOR CARRYING OUT THE INVENTION

As discussed above, to avoid the problems associated with automization of highly reactive alloyed and unalloyed metals and those metal alloys which have a large solidification range (at least 200° F.) the atomizer disk is coated with a compound C which includes, as its primary element, the base metal B of the metal L to be atomized. (Note: The base metal B of the metal L is hereinafter referred to as the "major" element of L. The "major" element of an unalloyed metal L is the metal itself.) The secondary element of the compound C is herein designated by the letter M. The element M is first selected on the basis that the compound C will have a melting point at least 50° F. higher than the temperature at which L is to be poured onto the spinning disk. Preferably the melting point of the compound C will be at least 300° F. higher than the pour temperature of L.

The element M is also selected such that the compound C, of which M is a part, can coexist with molten base metal B at the pour temperature of L (despite any solubility of M in B at process operating temperatures) as indicated by the binary phase diagram of M and B. If C and B can coexist at pour temperatures, then the compound C, in the form of a coating on the disk, is likely to remain stable under process operating conditions.

Preferably, to increase the likelihood of stability of the compound C, the element M is selected for its low solubility in B under process operating conditions, and the compound C will then have an even lower solubility in B such that the compound C is stable in L at the pour temperature of L. Preferably the solubility of M in B will be less than 10 atomic percent, most preferably less than 5 atomic percent under process operating conditions. The low solubility of both the compound C and the element M in B substantially eliminates the possibility of significant reactions between L and the coating C as L is poured onto it, despite the high pour temperatures; and, because both the disk coating C and the metal L include B, there is an immediate coupling between L and the coating C with the subsequent and substantially instantaneous formation of a stable skull of metal L. Once the skull is formed, very fine uncontaminated droplets of the metal L are thereafter flung from the spinning disk.

Coating the compound C on the disk may be accomplished in either of two ways. According to one aspect of the present invention, the secondary element M from which the compound C is made is first applied to the surface of the disk, such as by plasma spraying or other suitable technique. The molten metal L to be atomized is poured, as during a regular run, onto the surface of the coated, spinning disk and forms a coating of the compound C with the element M virtually instantaneously at the initiation of the run. Coupling, and the formation of a stable skull of the metal L occurs almost instantly thereafter. Pouring of molten L onto the disk may be continued in uninterrupted fashion to atomize the molten material. Alternatively the disk may simply be coated with compound C before the run, such as by plasma spraying. The powder resulting from the run should be the same whether the compound C is applied directly to the surface of the disk before the run or is formed during the initial seconds of a run, as described above. In either case, with the process of the present invention coupling of the liquid metal to the disk surface is assured and a stable skull is formed during the run. There is virtually no dissolving of the disk coating nor contamination of the powder being formed, even with highly reactive metals at high pour temperatures.

As discussed above, the process of the present invention is useful for making metal powders from metal alloys which have a wide (at least 200° F.) liquidus/-solidus temperature zone (i.e., solidification zone). Many alloys of Fe, Ni, Co, Cr, Mg, and Al fall within this category. Forming such metal alloys into powders by rotary atomization techniques requires that they be poured at temperatures considerably higher than their solidus or melting temperature in order that their temperature exceed their liquidus temperature by a sufficiently large amount (preferably by at least 200° F.). This assures that the liquid metal, during atomization, does not begin to solidify (except initially to form a stable skull) before it is flung off the spinning disk. Thus, for atomizing alloys such as those listed in Table I, the atomizer disk may initially be coated with, for example, Ta, Nb, Mo or Zr, which will form highly stable, high temperature compounds with aluminum, such as some of the aluminum compounds listed in Table II. Alternatively, these aluminum compounds may be applied (i.e., bonded) directly to the surface of the disk.

TABLE I

| Alloys of Aluminum | | | | | | |
|---|---|---|---|---|---|---|
| | Liquidus | | Solidus | | Δ T | |
| Alloy | °F. | °C. | °F. | °C. | °F. | °C. |
| Al—10Be | 1832 | 1000 | 1200 | 649 | 632 | 351 |
| Al—2Cb | 2190 | 1200 | 1223 | 662 | 967 | 538 |
| Al—10Co | 1635 | 890 | 1214 | 657 | 421 | 233 |
| Al—10Cr | 1700 | 926 | 1223 | 661 | 477 | 265 |
| Al—2Hf | 1630 | 890 | 1223 | 662 | 407 | 228 |
| Al—8Fe | 1575 | 850 | 1210 | 655 | 365 | 195 |
| Al—2Mo | 2012 | 1100 | 1355 | 737 | 367 | 363 |
| Al—5Zr | 2012 | 1100 | 1223 | 601 | 789 | 499 |
| Al—2V | 1832 | 1000 | 1223 | 662 | 609 | 338 |
| Al—5Ti | 2012 | 1100 | 1224 | 665 | 788 | 435 |
| Al—10B | 2318 | 1270 | 1787 | 975 | 531 | 295 |
| Al—8Fe—2Mo | 1830 | 1000 | 1300 | 704 | 530 | 296 |

TABLE II

| Melting Points of Elements and Compounds | | | | | |
|---|---|---|---|---|---|
| | Melting Point | | | Melting Point | |
| Element | °F. | °C. | Compound | °F. | °C. |
| Nb | 4474 | 2468 | $NbAl_3$ | 2925 | 1607 |
| | | | $Nb_2Al$ | 3403 | 1873 |
| Mo | 4730 | 2610 | $Mo_3Al$ | 3902 | 2150 |
| | | | $MoAl_2$ | 3686 | 2030 |
| Zr | 3389 | 1865 | $ZrAl_2$ | 2997 | 1647 |
| | | | $ZrAl_3$ | 2880 | 1582 |
| | | | ZrC | 6000 | 3316 |
| | | | ZrB | 5500 | 3038 |
| Ti | 3042 | 1672 | TiAl | 2682 | 1472 |
| | | | $TiAl_3$ | 2448 | 1342 |
| | | | $TiB_2$ | 5252 | 2900 |
| | | | TiC | 5600 | 3093 |
| | | | TiN | 5340 | 2949 |
| B | 4172 | 2300 | $AlB_{12}$ | 3758 | 2070 |
| Ta | 5432 | 3000 | $Al_3Ta$ | 2102 | 1550 |
| | | | $AlTa_2$ | 3632 | 2000 |

Pure aluminum becomes a liquid at about 1220° F. To form aluminum powder by rotary atomization, the aluminum must be superheated to at least about 1520° F. Above about 1800° F. aluminum is highly reactive with elements in the ceramics which are typically used to coat the surface of prior art atomizers. Many aluminum alloys present an even greater problem due to the existence of a wide solidification zone requiring higher pour temperatures which lead to increased reactivity. Table I lists the liquidus and solidus temperatures of several aluminum alloys and the difference (ΔT) therebetween, which is the size of the solidification zone. These alloys must be poured at temperatures at least 200° F. above their liquidus temperatures. If these alloys are poured directly onto a ceramic surface no skull or solidified layer would form on the atomizer, and thus no wetting or coupling of the molten alloy to the surface of the atomizer would occur.

Table III shows the solubility of various elements in liquid aluminum at various temperatures. This table may be used in conjunction with Table II for selecting coatings for a disk which is to be used to atomize, for example, some of the aluminum alloys of Table I. Nb, Mo, Zr, B, Ta, W and Ti are the most attractive as initial coatings for the atomizer disk due to their low solubility in liquid aluminum. Table II shows the melting points of some of the compounds which the elements of Table III would form upon being contacted with molten aluminum. Note the very high melting point of these compounds. The advantage of using these compounds as a disk coating, in addition to their high melting points, is that they are virtually nonreactive with liquid aluminum. The other elements of Table III, namely Co and Fe, although more soluble in aluminum, may also be satisfactory if the compounds which they form with aluminum can coexist with molten aluminum at the pour temperature of the aluminum. Table III is not intended to list all possible elements which may be useful in practicing the present invention.

TABLE III

| Solubility of Elements in Liquid Aluminum - Atomic Percent (Wt %) | | | |
|---|---|---|---|
| | Temperature | | |
| Element | 2000° F. | 2200° F. | 2400° F. |
| Nb | 0.5 (1.5) | 0.8 (2.4) | 2.0 (6) |
| Mo | 1.5 (4) | 3.0 (7) | 4.0 (10) |
| Zr | 1.7 (5) | 3.3 (10) | 6.0 (18.5) |
| B | 2.5 (5) | 4.0 (8) | 6.0 (12) |
| Ta | 7.0 (30) | 9.0 (40) | 11.0 (45) |
| Ti | 3.0 (5) | 6.5 (10) | |
| W | 4.0 (20) | 7.5 (36) | |
| Co | 18.0 (32) | 24.0 (41) | |
| Fe | 16.0 (27) | 38.0 (57) | |

In the case of metal alloys which are highly reactive at the temperatures at which they must be poured (whether or not those temperatures are very high) such that they would normally react with the ceramic coatings of the prior art, the same approach may be used as with alloys having a large solidification zone. Thus, the atomizer disk may initially be coated with a first metal which will form a stable compound with the base metal of the alloy under process operating conditions. Alternatively, such stable compounds may be applied directly to the surface of the disk. The first metal preferably has very low solubility in the base metal at pour temperatures, but need not if the compound formed can coexist with the base metal at process operating conditions. For example, titanium alloys and zirconium alloys may be atomized on a disk having a coating compound formed thereon of the base metal (Ti or Zr, as the case may be) with elements such as carbon, boron or nitrogen. Such compounds all have melting points greater than 5000° F. (See Table II). These compounds can all coexist with the base metals at the likely pour temperatures of the base metals, and, therefore, should be stable under process operating conditions.

If a highly reactive (at the pour temperature) unalloyed metal is to be atomized the same principles apply. The disk is coated with a first material which forms a stable compound with the metal to be atomized when they come into contact. Or such stable compound can be applied directly to the disk surface. The first material is selected such that the compound formed can coexist with the metal being poured under process operating conditions whereby dissolution of the coating does not occur. The compound must have a melting temperature at least 50° F. and preferably at least 300° F. higher than the metal pour temperature. To atomize unalloyed metals such as Ti and Zr, for example, the compounds of those metals with carbon, boron or nitrogen may be used.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. In the process of producing metal powder by pouring a liquid metal onto the surface of a spinning disk at a temperature at least 200° F. higher than its liquidus temperature, the steps of:

forming a coating on the disk of a compound C which is stable during the process and which comprises said metal if said metal is unalloyed and which, if said metal is an alloy, comprises the base metal of said alloy, wherein said compound has a melting point at least 50° F. higher than the pour temperature of the liquid metal, and wherein said liquid metal can coexist with said compound at the pour temperature of the liquid metal;

pouring a liquid stream of the said metal to be formed into a powder onto the coated, spinning disk at said pour temperature wherein coupling of said metal with the compound C occurs and a stable skull of said metal forms over the coating and fine liquid droplets of said metal are formed as said metal is flung off the disk;

cooling the liquid metal droplets after they leave the disk surface to solidify the droplets; and collecting the solidified droplets.

2. The process according to claim 1 wherein the step of forming a coating on the disk comprises first coating the disk with element M which forms the compound C upon being contacted with said liquid metal at said pour temperature, followed by pouring said liquid metal onto the spinning disk coated with M.

3. The process according to claim 1 wherein the metal powder to be produced is a titanium alloy, and the compound C is selected from the group consisting of TiC, $TiB_2$ and TiN.

4. The process according to claim 2 wherein the metal to be produced is a titanium alloy or a zirconium alloy, and the element M is selected from the group consisting of carbon and boron.

5. The process according to claim 1 wherein the metal powder to be produced is a zirconium alloy, and the compound C is selected from the group consisting of ZrC, $ZrB_2$, and ZrN.

6. In the process of producing metal powder by pouring a liquid metal alloy L onto the surface of a spinning disk wherein said metal alloy L has a solidification zone of at least 200° F. and comprises a base metal B and is poured at a temperature at least 200° F. higher than its liquidus temperature, the steps of:

forming a coating on the disk of a compound C of the base metal B, which compound has a melting point at least 50° F. higher than the temperature at which the alloy L is to be poured and wherein, at the pour temperature, the base metal B, in liquid form, and the compound C can coexist;

pouring a liquid stream of the alloy L onto the coated, spinning disk at said pour temperature wherein coupling of the alloy L with the compound C occurs and a stable skull of the alloy L forms over the coating of compound C and fine liquid droplets of the alloy L are formed as the alloy is flung off the disk;

cooling the droplets after they leave the disk to solidify the alloy L; and collecting the solidified alloy.

7. The process according to claim 6 wherein the base metal B is aluminum.

8. The process according to claim 7 wherein the compound C is a compound of aluminum and an element selected from the group consisting of Nb, Mo, Zr, Ti, Ta and B.

9. The process according to claim 6 wherein the compound C includes only elements which are soluble in the base metal B to an extent less than about 10 atomic weight percent under process operating conditions.

10. The process according to claim 6 wherein the compound C includes only elements which are soluble in the base metal B to an extent less than about 5 atomic weight percent under process operating conditions.

11. The process according to claim 6 wherein the disk includes a ceramic layer, and the step of forming a coating comprises coating over the ceramic layer.

12. The process according to claim 6 wherein a coating of the compound C is formed on the disk by plasma spraying the compound C onto the disk.

13. The process according to claim 6 wherein the step of forming a coating of the compound C on the disk comprises first coating the disk with an element which will form the compound C with the base metal B at the pour temperature of the liquid alloy L, followed by said step of pouring the liquid alloy L onto the spinning disk coated with M to form the coating of compound C and to subsequently form said stable skull of alloy L over said coating.

14. The process according to claim 13 wherein M has a solubility in the base metal B of less than about 10 atomic weight percent under process operating conditions.

15. The process according to claim 14 wherein the base metal B is aluminum, and M is selected from the group consisting of Nb, Mo, Zr, Ti, Ta and B.

16. In the process of producing metal powder by pouring a liquid metal alloy L onto the surface of a spinning disk, wherein said alloy L comprises a base metal B and is poured at a temperature at least 200° F. higher than its liquidus temperature, the steps of:

coating the spinning disk with an element M which will form a compound C with the base metal B at the temperature at which the metal L is poured, the compound C having a melting point higher than the melting point of M and higher than the temperature at which the metal L is to be poured, wherein the solubility of the material M in the base metal B is less than about 10 atomic percent under process operating conditions and the solubility of the compound C in the base metal B will be less than the solubility of M in B;

pouring a liquid stream of the metal L onto the spinning disk coated with M to form a solidified layer of the compound C on the surface of the disk as the metal L is poured;

continuing to pour the metal L onto the solidified layer whereby coupling of the metal L with the solidified layer of the compound C occurs and a stable skull of the metal L forms on the surface of the solidified layer and fine liquid droplets of the metal L are formed as the liquid metal L is flung off the disk;

cooling the liquid metal L after it leaves the disk surface to solidify the metal L; and collecting the solidified metal L.

* * * * *